US005790920A

United States Patent [19]

Teramura et al.

[11] Patent Number: 5,790,920

[45] Date of Patent: Aug. 4, 1998

[54] TONER IMAGE PROCESSING APPARATUS

[75] Inventors: Osamu Teramura, Fukushima; Hiroyuki Yajima, Tokyo, both of Japan

[73] Assignees: Oki Data System Co., Ltd., Fukushima; Oki Data Corp., Tokyo, both of Japan

[21] Appl. No.: 892,310

[22] Filed: Jul. 14, 1997

[30] Foreign Application Priority Data

Jul. 19, 1996 [JP] Japan ..... 8-191184

[51] Int. Cl.[6] ..... G03G 21/10

[52] U.S. Cl. ..... 399/71; 399/99

[58] Field of Search ..... 399/71, 343, 358, 399/98, 99

[56] References Cited

U.S. PATENT DOCUMENTS 4,970,552 11/1990 Okamoto et al. .
5,059,991 10/1991 Morisawa .
5,270,784 12/1993 Nakane et al. .
5,390,006 2/1995 Wakabayashi et al. .
5,613,174 3/1997 Denton et al. ..... 399/98

FOREIGN PATENT DOCUMENTS 5-197237 8/1993 Japan .
8-244277 9/1996 Japan .

OTHER PUBLICATIONS

*Patent Abstracts of Japan*, Section P, Sec. No. 284, vol. 8, No. 1441, p. 162 and JP-A-59044066, Mar. 1984.

*Primary Examiner*—R. L. Moses
*Attorney, Agent, or Firm*—Rabin & Champagne, P.C.

[57] ABSTRACT

A toner image processing apparatus performs a printing operation and a cleaning operation. A toner-attracting electrode includes first and second electrodes disposed closer to the charged surface of a photosensitive drum and outside of a path through which the light from the exposing device illuminates the charged surface. During the toner attracting operation, a toner-recovering device causes the toner-attracting electrode to attract the toner particles floating in the air surrounding the exposing device, and reversely charged toner particles and residual toner particles left on the photosensitive drum after the toner image is transferred to the print medium. During the toner-releasing operation, the toner-recovering device causes the toner-attracting electrode to release the attracted toner particles to the photosensitive drum. The toner-attracting operation is performed during the printing operation and the toner-releasing operation is performed during the cleaning operation.

4 Claims, 4 Drawing Sheets

TONER IMAGE PROCESSING APPARATUS

BACKGROUND OF THE INVENTION

1. Field of the Invention

The present invention relates to a toner image processing apparatus for use in an electrophotographic printer.

2. Description of Related Art

A conventional electrophotographic printer incorporates a toner image processing apparatus. A photosensitive drum is rotated in a predetermined direction and the surface of the photosensitive drum is uniformly negatively charged by a charging device. The negatively charged surface is then exposed to light emitted from an exposing device such as an LED (light emitting diode) head, so that an electrostatic latent image is formed in accordance with print data. The electrostatic latent image is then developed with negatively charged toner by a developing device. The toner image is then transferred to a print medium such as print paper. After transferring operation, the cleaning member such as a roller cleans the surface of the photosensitive drum in order to remove the residual toner on the photosensitive drum.

With the aforementioned conventional toner image processing apparatus, some toner is still left on the surface of the photosensitive drum after the cleaning operation by the cleaning member. When the photosensitive drum is again negatively charged by the charging device after the cleaning operation, the residual toner is charged to the same potential as the photosensitive drum. Thus, such residual toner is no longer attracted by the surface of the photosensitive drum, falling from the surface of the photosensitive drum to float in the air and eventually adhere to, for example, the lens surface of the exposing device. The toner adhering to the lens reduces an amount of light passing through the lens. Decreases in the amount of light result in unwanted diffusion of light and variations in the amount of light that illuminates the charged photosensitive drum, leading to poor quality of printed image.

Therefore, the surface of the lens of the exposing device must be cleaned periodically. This makes maintenance and supervision of the image processing apparatus cumbersome.

SUMMARY OF THE INVENTION

An object of the invention is to provide a toner image processing apparatus which eliminates possibility of floating toner adhering to, for example, an exposing device and causes poor image quality.

A toner image processing apparatus includes an exposing device, photosensitive drum, toner-attracting electrode, and toner-recovering device, and performs a printing operation and a cleaning operation. The toner-attracting electrode includes first and second electrodes disposed closer to the charged surface of a photosensitive drum and outside of a path through which the light from the exposing device illuminates the charged surface. During the printing operation, the toner-recovering device causes the first and second electrodes to attract the toner particles floating in the air surrounding the exposing device, and reversely charged toner particles and residual toner particles left on the photosensitive drum after the toner image is transferred to the print medium. During the cleaning operation, the toner-recovering device causes the first and second electrodes to release the attracted toner particles to the photosensitive drum. The negatively charged residual toner particles and floating toner particles are eventually recovered by the developing roller and are reused as developer toner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
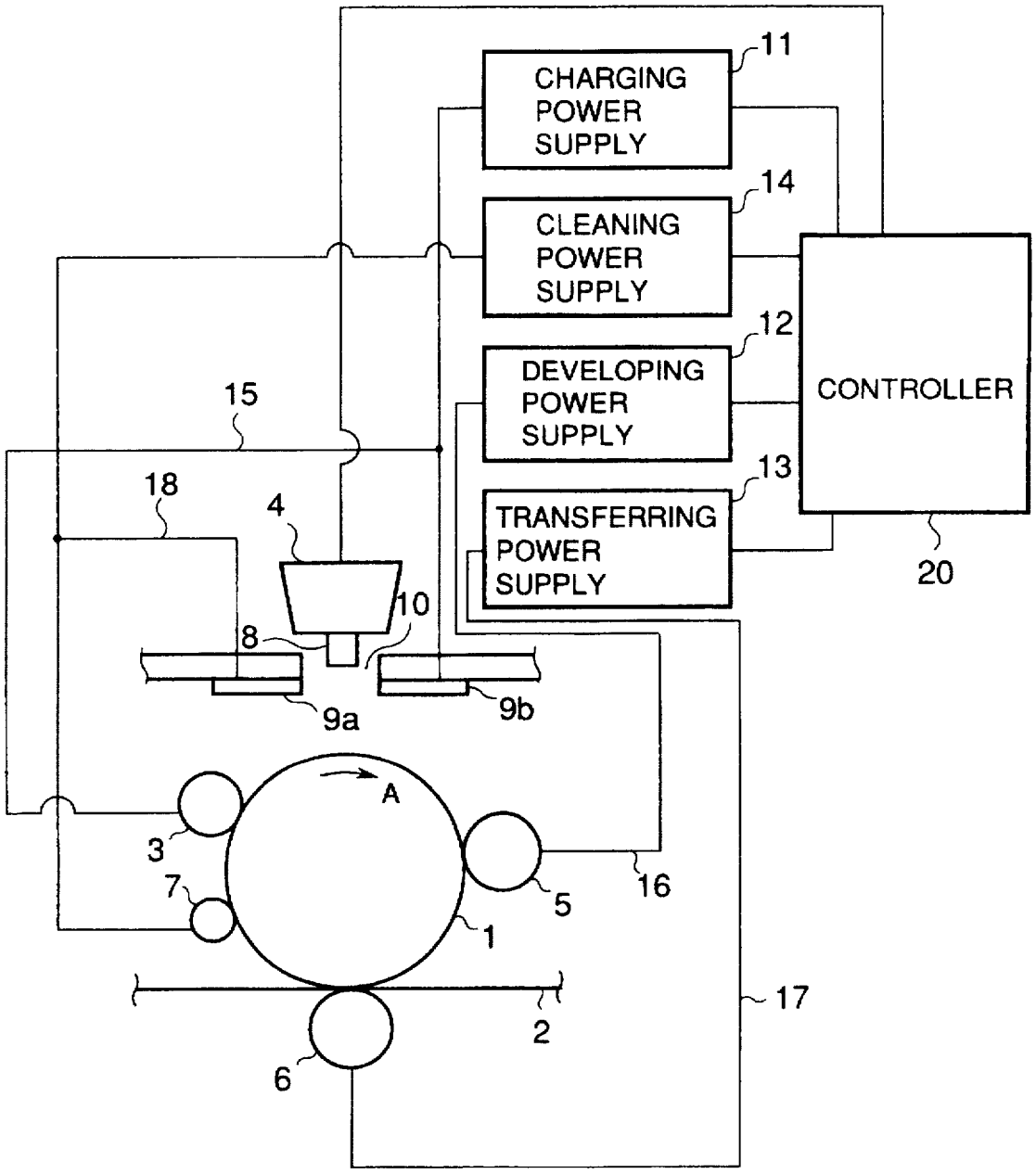
FIG. 1 illustrates a general construction of a toner image processing apparatus according to a first embodiment of the invention.

A preferred embodiment of the invention will be described in detail with reference to the accompanying drawings. Like elements have been given like reference numerals throughout the drawings.

FIG. 1 illustrates a general construction of a toner image processing apparatus according to a first embodiment of the invention.

A photosensitive drum 1 is rotated in a direction shown by arrow A about its rotational axis and print paper 2 is fed to the photosensitive drum 1 in a laterally centered position. The surface of the photosensitive drum 1 is negatively charged by a charging roller 3. Then, an LED head 4 as an exposing device emits light through a lens 8 to illuminate the negatively charged surface, the light forming an electrostatic latent image on the charged surface in accordance with print data. The electrostatic latent image is then developed with negatively charged toner into a toner image by a developing roller 5. The toner image is then transferred by a transfer roller 6 to the print paper 2. After transferring the toner image, the surface of the photosensitive drum 1 is then cleaned by a cleaning roller 7.

A toner attraction electrode 9 is supported by a chassis of the toner image processing apparatus in such a way that the toner attraction electrode 9 directly opposes the photosensitive drum 1 and is closer to the photosensitive drum than the LED head 4. The toner attraction electrode 9 includes first and second electrodes 9*a* and 9*b* disposed with a space 10 therebetween. The light emitted from the LED head 4 passes through the space 10 to illuminates the surface of the photosensitive drum 1. The first electrode 9a is on the charging roller side and the second electrode 9b is on the developing roller side. When the first and second electrodes 9a and 9b receive voltages, these electrodes attract residual toner particles and reversely charged toner particles on the photosensitive drum 1, and toner particles that float in the air near the lens 8.

The charging roller 3, developing roller 5, transfer roller 6, and cleaning roller 7 are connected to a charging power supply 11, developing power supply 12, transferring power supply 13, and cleaning power supply 14 via power lines 15 to 18, respectively. The first and second electrodes 9a and 9b receive voltages from the cleaning power supply 14 and the charging power supply 11 via the power lines 18 and 15, respectively. This arrangement simplifies the construction of the image processing apparatus.

A controller 20 includes a CPU and memory. The controller 20 is connected to the LED head 4, charging power supply 11, developing power supply 12, transferring power supply 13, and cleaning power supply 14, and controls the operations thereof.

When printing operation is performed, the controller 20 causes the charging power supply 11 and cleaning power supply 14 to turn on, so that the first electrode 9a receives a positive high voltage to attract the toner particles floating in the air surrounding the LED head 4 and the second electrode 9b receives a negative high voltage to attract reversely charged (positively charged) residual toner particles still left on the photosensitive drum 1 after transfer operation.

Most of the negatively charged toner particles are transferred to the print paper 2 during the printing operation. Most of the residual negatively charged toner particles which are left on the drum are attracted to the cleaning roller 7. Negatively charged toner particles which failed to be attracted to the cleaning roller 7 are attracted to the first electrode 9a.

Some of the negatively charged toner particles receive positive charges from the transfer roller 6 to become positively charged, i.e., reversely charged toner particles. Also, some of the residual negatively charged toner particles on the cleaning roller 7 receive positive charges from the cleaning roller 7 to become reversely charged. Most of the reversely charged toner particles are attracted to the charging roller 3. However, some of the reversely charged toner particles fail to be attracted to the charging roller 3 and are attracted to the second electrode 9b. The reversely charged toner particles attracted to the charging roller 3 will become negatively charged while rotating together with the charging roller 3 and migrate to the photosensitive drum 1. When such toner particles migrate to the photosensitive drum 1 (−800 V), they are repelled by Coulomb force into the air, becoming floating toner particles. The floating toner particles in the air are then attracted by the first electrode 9a.

In this manner, the first and second electrodes 9a and 9b hold the attracted toner particles during the printing operation.

When cleaning operation is performed, the controller 20 causes the first and second electrodes 9a to release the toner particles, which have been attracted thereto, to the photosensitive drum 1. The negatively charged toner particles on the cleaning roller 7 and on the first electrode 9a are then recovered by the developing device via the developing roller 5.

The reversely charged toner particles on the charging roller 3 and on the second electrode 9b migrate via the drum 1 to the cleaning roller 7. The reversely charged toner particles on the cleaning roller 7 are then migrate via the photosensitive drum 1 to the charging roller 3 during the next printing operation. The aforementioned process is repeated. Thus, the controller serves as a toner recovering device.

Figure 2:
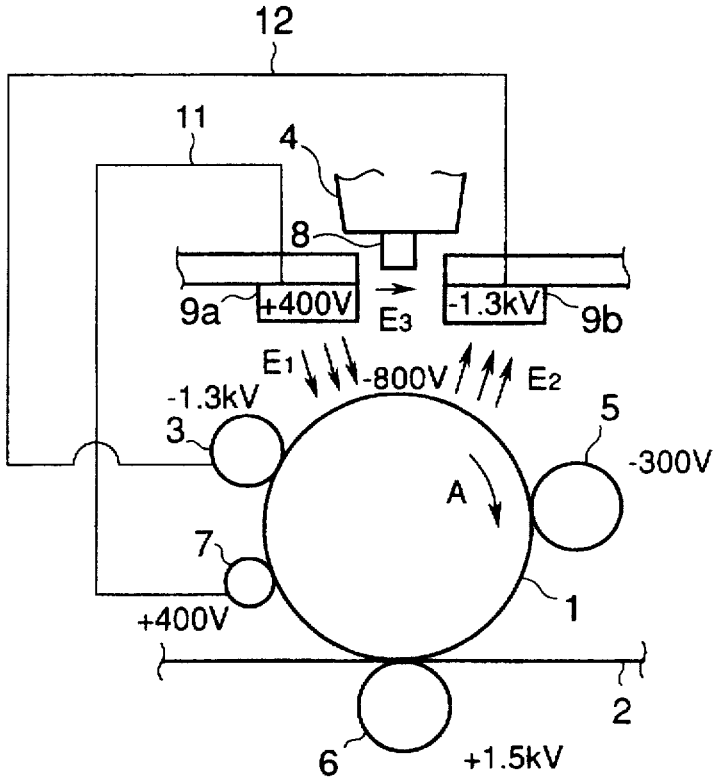
FIG. 2 illustrates voltages applied to the various structural elements when printing operation is being performed.
Figure 3:
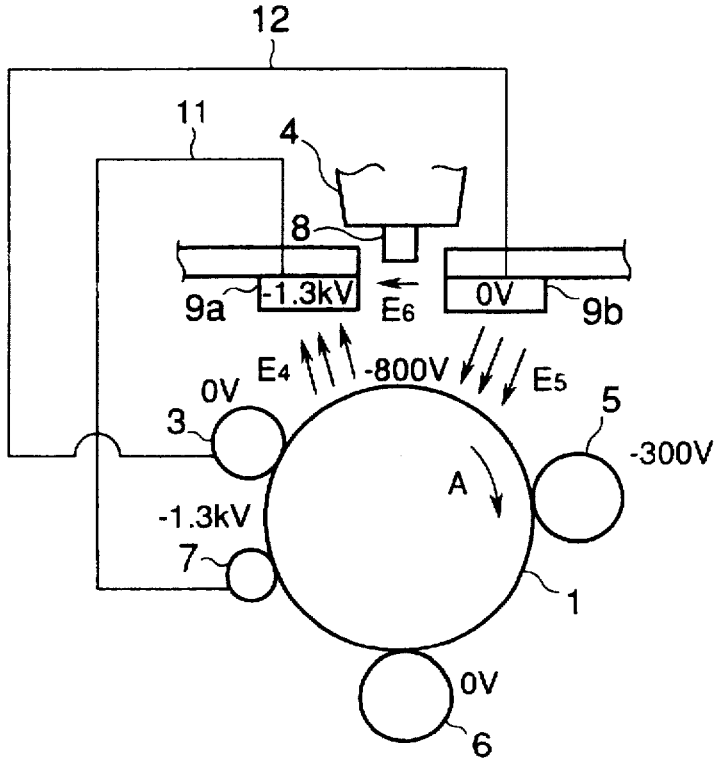
FIG. 3 illustrates voltages applied to the various structural elements when cleaning operation is being performed.

FIG. 2 illustrates voltages applied to the various structural elements during printing operation and FIG. 3 illustrates voltages applied to the same structural elements during cleaning operation.

During printing operation, the charging roller 3, developing roller 5, transferring roller 6, and cleaning roller 7 receive voltages of −1.3 kV, −300 V, +1.5 kV, and +400 V, respectively. Since the first and second electrodes 9a and 9b are connected to the cleaning roller 7 and charging roller 3, respectively, the first and second electrodes 9a and 9b receive voltages of +400 V and −1.3 kV, respectively. Thus, the charging roller 3 causes the surface of the photosensitive drum 1 to be charged to −800 V, so that an electric field E1 is developed between the photosensitive drum 1 and the first electrode 9a, an electric field E2 is developed between the photosensitive drum 1 and the second electrode 9b, and an electric field E3 is developed between the first electrode 9a and the second electrode 9b.

During cleaning operation, the charging roller 3, developing roller 5, transferring roller 6, and cleaning roller 7 receive voltages of zero volts, −300 V, zero volts, and −1.3 kV, respectively. The first and second electrodes receive voltages of −1.3 kV and zero volts, respectively. Thus, the cleaning roller 7 causes the surface of the photosensitive drum 1 to be charged to −800 V, so that an electric field E4 is developed between the photosensitive drum 1 and the first electrode 9a, an electric field E5 is developed between the photosensitive drum 1 and the second electrode 9b, and an electric field E6 is developed between the first and second electrodes 9a and 9b.

The printing operation of the image processing apparatus will now be described with reference to FIGS. 2, 4, and 5.

Figure 4:
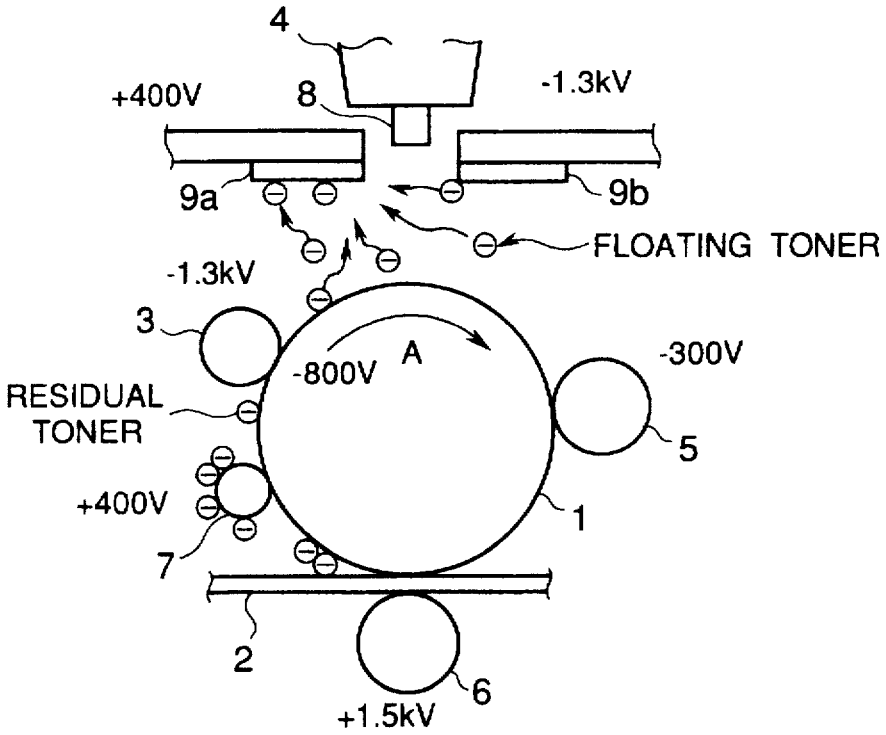
FIG. 4 illustrates floating toner particles and residual toner particles when printing operation is being performed.

FIG. 4 illustrates toner particles floating in the air and residual toner particles on the photosensitive drum when printing operation is being performed. FIG. 5 illustrates reversely charged toner particles when the printing operation is being performed.

During printing operation, voltages are applied to the respective rollers as shown in FIG. 2. The surface of the photosensitive drum 1 is uniformly charged by the charging roller 3 to −800 V and the LED head 4 illuminates the surface in accordance with the print data, the potential of parts of the surface exposed to the light becomes about zero volts, forming an electrostatic latent image. The electrostatic latent image is then supplied with toner from the developing roller 5. The negatively charged toner is deposited by static electricity on the electrostatic latent image to form a toner image. The toner image is then transferred by static electricity to the print paper 2 positively charged by the transfer roller 6.

Most of the toner on the photosensitive drum 1 is transferred to the print paper 2 but some of the toner i.e., residual toner particles, is left on the surface of the photosensitive drum 1. As shown in FIG. 4, the residual toner particles are recovered by the cleaning roller 7 but some of them are still left on the photosensitive drum 1. Since the residual toner particles are negatively charged, the toner particles migrate along the electric fields E1, E2, and E3 to the first electrode 9a.

Some of the negatively charged toner particles acquire positive charges from the transfer roller 6 which receives a voltage of +1.5 kV and from the cleaning roller 7 which receives a voltage of +400 V, and become positively charged. these positively charged toner particles are referred to as reversely charged toner particles.

Figure 5:
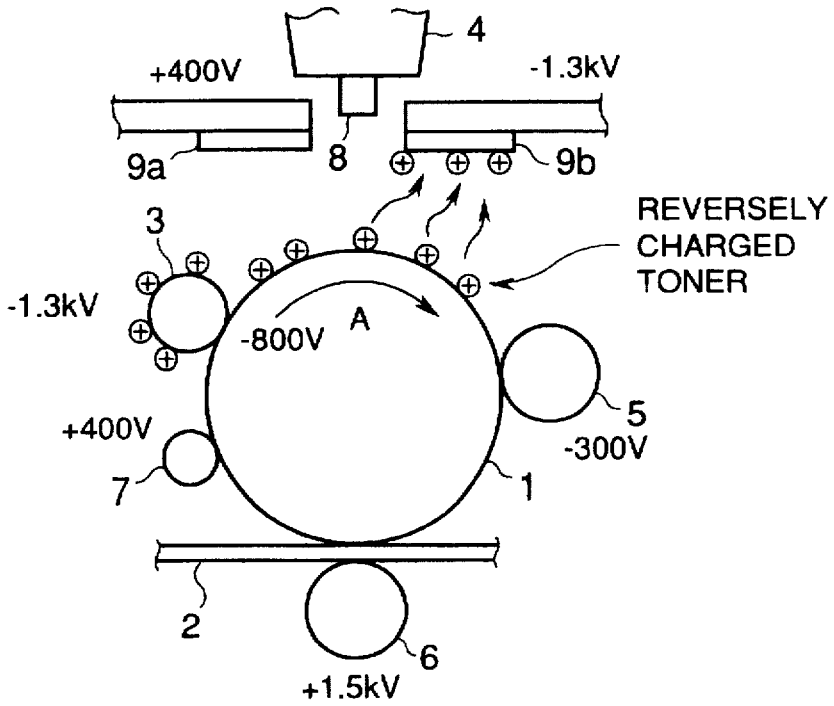
FIG. 5 illustrates reversely charged toner particles when printing operation is being performed.

The reversely charged toner particles migrate, as shown in FIG. 5, to the charging roller 3 to which a voltage of −1.5 kV is applied. Some of the toner particles which have not migrated to the charging roller 3 move along the electric fields E1, E2, and E3 to the second electrode 9*b*.

The reversely charged toner particles which have migrated to the surface of the charging roller 3 are charged to the same potential as the charging roller 3 while the charging roller 3 rotates. Such toner particles are repelled by the photosensitive drum 1 into the air, becoming floating toner particles. Since the floating toner particles are negatively charged, they migrate along the electric field E1 to the first electrode 9*a*.

The cleaning operation of the image processing apparatus will now be described with reference to FIGS. 3, 6, and 7.

Figure 6:
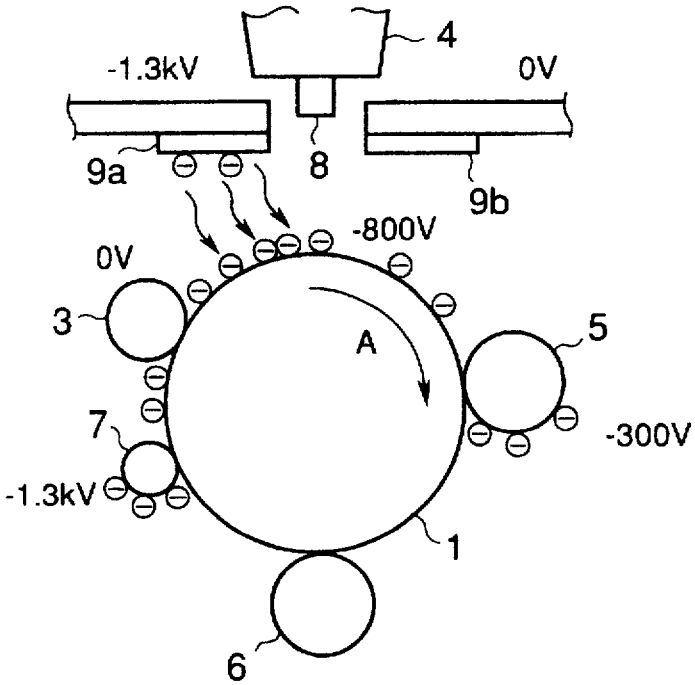
FIG. 6 illustrates toner particles moving from the first electrode to the photosensitive drum during cleaning operation.

FIG. 6 illustrates negatively charged toner particles moving from the first electrode 9*a* to the photosensitive drum 1 when cleaning operation is being performed. FIG. 7 illustrates reversely charged toner particles moving from the second electrode 9*b* to the photosensitive drum when cleaning operation is being performed.

During cleaning operation, the charging roller 3 and cleaning roller 7 receive voltages of zero volts and −1.3 kV, respectively, as shown in FIG. 3. Since the photosensitive drum 1 is charged by the cleaning roller 7 to −800 V, the negatively charged toner particles on the cleaning roller 7 migrate from the cleaning roller 7 to the photosensitive drum 1 along the electric field while the negatively charged toner particles on the first electrode 9*a* migrate along the electric field E4 to the photosensitive drum 1 as shown in FIG. 6. The toner particles migrated to the photosensitive drum 1 are subsequently recovered by the developing roller 5.

Figure 7:
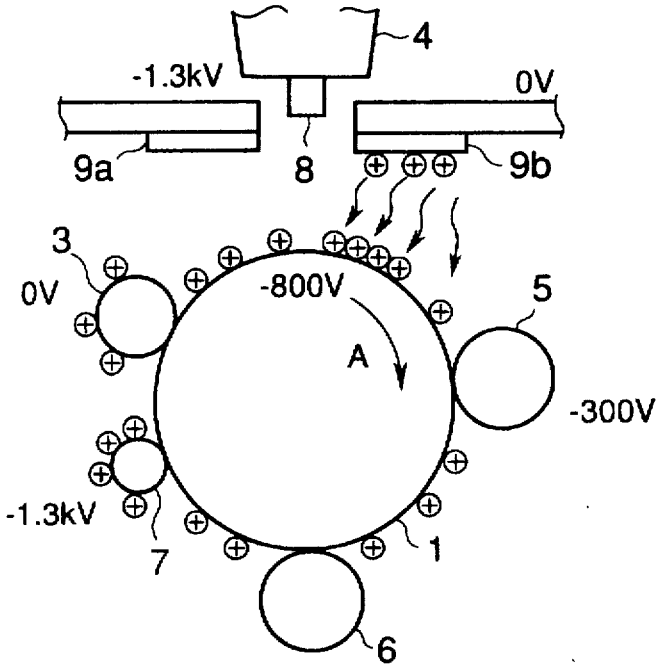
FIG. 7 illustrates reversely charged toner particles moving from the second electrode to the photosensitive drum during cleaning operation.

Since the reversely charged toner particles are of positive polarity, they migrate along the electric fields from the charging roller 3 to the photosensitive drum 1 and from the second electrode 9*b* to the photosensitive drum 1 as shown in FIG. 7. The toner particles migrated to the photosensitive drum 1 are subsequently collected by the cleaning roller 7.

As described above, the negatively charged residual toner particles and floating toner particles are eventually recovered by the developing roller 5 and are reused as developer toner.

The cleaning operation is performed upon power-up of the apparatus, during idling periods of the apparatus immediately before printing operations, after continuous printing of, for example, 20 pages, and when the cover is opened and closed. Performing printing operation alternately with cleaning operation is effective in preventing soiling of the lens 8 of the LED head 4, simplifying the maintenance and supervision of the image processing apparatus.

While the embodiment has been described with respect to the first electrode 9*a* that receives the same voltage as the cleaning roller 7 and the second electrode 9*b* that receives the same voltage as the charging roller 7, the first and second electrodes 9*a* and 9*b* may be constructed to receive voltages, independently of the respective rollers.

Although the surface of the photosensitive drum 1 and the developer toner are negatively charged, they may be positively charged. If they are positively charged, then the first and second electrodes 9*a* and 9*b* receive a negative potential and a positive potential, respectively, during printing operation, and a positive potential and a negative potential, respectively, during cleaning operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner image processing apparatus for performing a printing operation where light emitted from an exposing device illuminates a charged surface of a photosensitive drum to form an electrostatic latent image, the electrostatic latent image is then developed with toner into a toner image by a developing device, and the toner image is transferred to a print medium, and a cleaning operation where toner particles which have failed to be transferred to the print medium are recovered by the developing device, the apparatus comprising:

a toner-attracting electrode disposed closer to the charged surface than the exposing device and outside of a light path through which the light from the exposing device illuminates the charged surface; and a toner-recovering device, performing a toner attracting operation where the toner-attracting electrode attracts the toner particles floating in the air surrounding the exposing device, and reversely charged toner-particles and residual toner particles left on the photosensitive drum after the toner image is transferred to the print medium, and a toner-releasing operation where the toner-attracting electrode releases the attracted toner particles to the photosensitive drum, the toner-attracting operation being performed during the printing operation and the toner-releasing operation being performed during the cleaning operation.

2. The toner image processing apparatus according to claim 1, wherein the surface of the photosensitive drum is negatively charged before the electrostatic latent image is formed thereon and negatively charged toner particles are supplied to the electrostatic latent image from the developing device.

3. The toner image processing apparatus according to claim 1, wherein the toner-attracting electrode includes a first electrode and a second electrode disposed along the charged surface of the photosensitive drum and in a direction in which the photosensitive drum rotates; and the toner-recovery device applies a first voltage more positive than the surface of the photosensitive drum to the first electrode and a second voltage more negative than the surface of the photosensitive drum to the second electrode during the toner-attracting operation, and a third voltage more negative than the surface of the photosensitive drum to the first electrode and a fourth voltage more positive than the surface of the photosensitive drum to the second electrode during the toner-releasing operation.

4. The toner image processing apparatus according to claim 3, further including a charging device for charging the surface of the photosensitive drum before the surface is exposed to the light emitted from the exposing device, and a cleaning member for cleaning the charged surface of the photosensitive drum after the toner image is transferred to the print medium, wherein the first electrode receives a first same voltage as the cleaning member and the second electrode receives a second same voltage as the charging device.

* * * * *